US007121693B2

(12) United States Patent
Klose

(10) Patent No.: US 7,121,693 B2
(45) Date of Patent: Oct. 17, 2006

(54) LAMP, ESPECIALLY FOR ILLUMINATING INTERIORS

(75) Inventor: Leonard Klose, Lüdenscheid (DE)

(73) Assignee: Erco Leuchten GmbH, Ludenscheid (DE)

( * ) Notice: Subject to any disclaimer, the term of this patent is extended or adjusted under 35 U.S.C. 154(b) by 0 days.

(21) Appl. No.: 10/660,374

(22) Filed: Sep. 11, 2003

(65) Prior Publication Data

US 2004/0085771 A1 May 6, 2004

(30) Foreign Application Priority Data

Sep. 11, 2002 (DE) ..... 102 42 441

(51) Int. Cl.
*F21V 7/04* (2006.01)
*F21V 5/00* (2006.01)

(52) U.S. Cl. ..... 362/331; 362/268; 362/308; 362/327; 362/299

(58) Field of Classification Search ..... 362/268, 362/299, 308, 327, 31, 331, 626; 359/626, 359/599, 619, 621, 622, 623, 625, 628
See application file for complete search history.

(56) References Cited

U.S. PATENT DOCUMENTS 3,586,592 A * 6/1971 Cahn ..... 428/29
3,735,124 A 5/1973 Stahlhut
5,521,725 A 5/1996 Beeson et al.
5,644,431 A * 7/1997 Magee ..... 359/619
5,674,001 A * 10/1997 Weigert ..... 362/308
5,689,372 A * 11/1997 Morton ..... 359/623
5,795,057 A * 8/1998 Weigert ..... 362/268
6,033,094 A 3/2000 Sohn
6,046,855 A * 4/2000 Goto ..... 359/619
6,124,974 A * 9/2000 Burger ..... 359/621
6,213,625 B1 * 4/2001 Leadford et al. ..... 362/331
6,721,101 B1 * 4/2004 Daniell ..... 359/626

FOREIGN PATENT DOCUMENTS

| | | |
|---|---|---|
| DE | 1 497 293 | 6/1969 |
| DE | 33 24 028 | 1/1985 |
| DE | 198 22 846 | 6/2000 |
| EP | 0738904 | 10/1996 |
| EP | 0846914 | 6/1998 |
| EP | 0999407 | 5/2000 |

* cited by examiner

*Primary Examiner*—Sandra O'Shea
*Assistant Examiner*—Anabel Ton
(74) *Attorney, Agent, or Firm*—Andrew Wilford; Jonathan Myers

(57) ABSTRACT

A lamp assembly having a lens plate covering the opening and spaced from the lamp. The lens plate is provided with a multiplicity of microlenses such that the lens plate and lamp assembly generates a well defined light cone with a sharp demarcation between the dark region outside the light cone and the illuminated region within the light cone and the illumination within the light cone is homogeneous.

10 Claims, 3 Drawing Sheets

LAMP, ESPECIALLY FOR ILLUMINATING INTERIORS

FIELD OF THE INVENTION

The present invention relates to a lamp and especially a lamp for illuminating interiors. More particularly this invention relates to a lamp of the type having a housing adapted to be mounted at an upper level and having a light outlet opening, containing a light source and which casts through the opening a light cone onto a surface, e.g. a floor. The invention relates, therefore, to a lamp assembly including that lamp housing and the light source or lamp therein.

BACKGROUND OF THE INVENTION

Such lamp assemblies are available in a wide variety of variants, especially for illuminating building interiors. The lamp assemblies cast their light cones upon the floor surfaces of the building and generally are mounted in ceilings or at other upper levels in the structure. They can be mounted on the roof or in the roof structures as well. It should be understood, however, that such lamps may be mounted on walls of the building to illuminate floor and wall regions and can, if desired or required, be mounted on exterior surfaces of a building.

Where a view of the lamp or light source is not desirable, the lamp opening may be provided with a lens or diffuser and frequently a dark light reflector can be provided on the light source or in the lamp housing. Reflectors do tend to make the light cone reasonably well defined and do limit losses from the region in which maximum illumination is to occur. The lamp may also be provided with a diaphragm or other shield surrounding the opening from which the light emerges to assist in making the light cone sharp and in maintaining the region beyond the light cone free from illumination or in shadow.

A dark light reflector has the advantage, in addition, that the light source within the housing cannot easily be distinguished.

At the opening to the housing, gridlike structures which may have straight or curved surfaces can be provided as light guides and to mask the lamp or other light emitting structure within the housing.

Diffusers do not have effects similar to those of conventional dark light reflectors and it is difficult with such diffusers to obtain the advantages of dark light reflectors in illuminating lamps.

German Patent document DE-OS 1 497 293 discloses a light distributing plate at the outlet of a lamp housing which is formed with prismatic elements and which deflect and reflect the light from the source and thereby mask the source and distribute the light as may be required.

In a catalog of the assignee of the present application issued in the years 2000/2001 and entitled "Lighting Program" page 340, a prismatic lens is provided to close a lamp housing. The lens plate here has prismatic elements similar to those of DE-OS 1 497 293, although the prism points are slightly rounded. The use of this lens plate is intended to generate a brightening effect with a decorative purpose and, while the lamp within the housing is shielded, a multiplicity of light points can be readily noted in the housing closure element.

OBJECTS OF THE INVENTION

The principal object of the present invention is to provide a lamp assembly which has a lamp housing and a light source or lamp and a lamp opening as has been described at the outset but whereby the lamp generates a sharp edged light cone which is substantially homogeneous, i.e. across its cross section has no light peaks or darker regions which are discernable and whereby an observer cannot distinguish in the light cone discrete light points which have been a drawback heretofore.

Another object is to provide a lamp assembly which has advantages of the system of DE OS 1 497 293 and the catalog unit mentioned but without the disadvantageous characteristic that discrete light points are discernable in the light cone or at the lamp opening.

SUMMARY OF THE INVENTION

These objects and others which will become apparent hereinafter are attained, in accordance with the invention in a lamp assembly which comprises:

a lamp housing having a light-emitting opening turned in a direction of a surface to be illuminated;

at least one lamp in the housing for producing light which is emitted in a light cone toward the surface; and a lens plate disposed across the opening and comprised of a multiplicity of microlenses for rendering the light cone as it passes through the lens plate substantially homogeneous and sharp-edged where the light cone meets the surface.

According to the invention, a sharp edged and substantially homogeneous light cone is produced by the microlenses formed unitarily on the lens plate which is provided in the region of the light output opening.

The principle of the invention is that, while in the past conventional prismatic elements have been used between the lamp and the illuminated region, these prismatic elements function more or less as re-emitting point sources of light whereas the multiplicity of microlenses of the lens plate in accordance with the invention, especially where the microlenses are defined by spherical lens surfaces, function like collecting lenses or dispersing lenses which thus prevent discrete points of light from being discerned across the light cone which is emitted from the lens plate.

In contrast to an arrangement in which prismatic elements are provided as in the state of the art, the lens plate functions as a distribution plate for the light with each circular surface and each spherical surface providing a homogeneous ring shaped light output which lies fully within the sharp edged cone but in which the outwardly spreading light merges with the outwardly spreading light from adjacent microlenses to eliminate the point source reillumination of a prismatic lens plate.

Since a multiplicity of microlenses are provided, the light source itself or a plurality of light sources within the housing can no longer be directly visible and no longer contribute discrete light points which are passed through the plate and are readily discernable.

The esthetics of the lamp assembly are improved since discrete discernment of light sources is completely avoided.

If an observer is in the shadow region, the observer sees the entire lens plate as a substantially homogeneous dark element and light from that dark element practically does not fall on an observer, by contrast with a prismatic plate lens on a lamp which will always cast some light into the regions around a light cone and cause the viewer to be in the path of light from a brilliant light point of the prismatic lens if not from the light source originally. This scattering of light outside the intended light cone, of course, reduces the efficiency of illumination in the intended region within a sharp edge cone.

While I have used the term "light cone" here, it should be noted that this term is used in its general sense in association with illumination and may not mean that the geometric pattern light cast on the surface is exactly that of a geometric cone. The light from a point source through an opening directed on a surface may of course correspond in geometry to that of a cone. However, the light from the microlens plate, while cast on the surface with a well defined boundary may have some other geometric shape although it will widen from the lens plate toward the surface in the manner of a light cone. The actual light pattern cast upon the surface can be elongated and can have a rectangular cross section, especially when the light emitting open is longitudinal and the lamp itself maybe an elongated lamp generating an elongated light field. The light cone in the sense of the invention is the light pattern cast upon the illuminated region with a sharply defined boundary.

The invention will be found to be of greatest use wherever a substantially completely homogeneous light cone is desired or necessary. However, it may be useful as well where the lamp is required to produce a light cone which is not continuously homogeneous but, for example, can have an asymmetric light distribution.

The lamp assembly of the invention has the advantage that it can have an especially flat configuration. It is, therefore, possible to provide an electronic accessory in the case of an axially elongated lamp, not an axial alignment behind the light source but rather substantially within the axial length of the light source above the light source so that the light source is disposed between the electronic accessory and the lens plate and in spite of this arrangement will allow the lamp assembly to retain its flat configuration. Such an accessory may be a switching system or a power system for the light source.

By contrast with arrangements having prismatic elements which have defined planar outer surfaces, each microlens of the invention is defined only by curved surfaces, preferably with constant radii of curvature. While it is true that a lens in principle may be considered an infinite number of adjoining prisms, the light cone which results from the lens plate of the invention is much more homogeneous than can be obtained from any prism plate.

The arrangement of a multiplicity of microlenses adjacent one another is particularly advantageous. This insures a maximum light output and optimal dark light effect.

According to a feature of the invention, the microlenses are formed by a structuring of at least one surface of the lens plate, thereby enabling simple and inexpensive formation thereof. The lens plate has two surfaces, one of which is turned toward the light source and the other of which is turned toward the opening surface to be illuminated. According to the invention, one of these surfaces is formed unitarily with a multiplicity of recesses of generally spherical configuration while the other surface is formed with a multiplicity of convexities, generally associated with respective recesses to produce the respective microlens. The convexities are of a spherical nature as well. The convexities and the respective recesses can combine to form lenses which can be on at least one surface of the lens plate and either can be turned toward the light source or turned away from the light source. Preferably, such curved concavities or convexities are provided on both surfaces and in a most preferred form, the spherical concavities are turned toward the light source and the spherical convexities are turned toward the surface to be illuminated. This configuration enables each microlens to be of the concavo-convex type.

According to a feature of the invention, the center points of the concavities or convexities may be spaced apart by a distance of less than 5 mm, preferably less than 3 mm and in a more preferred embodiment, less than 2 mm and in the most preferred state, more than 1 mm.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
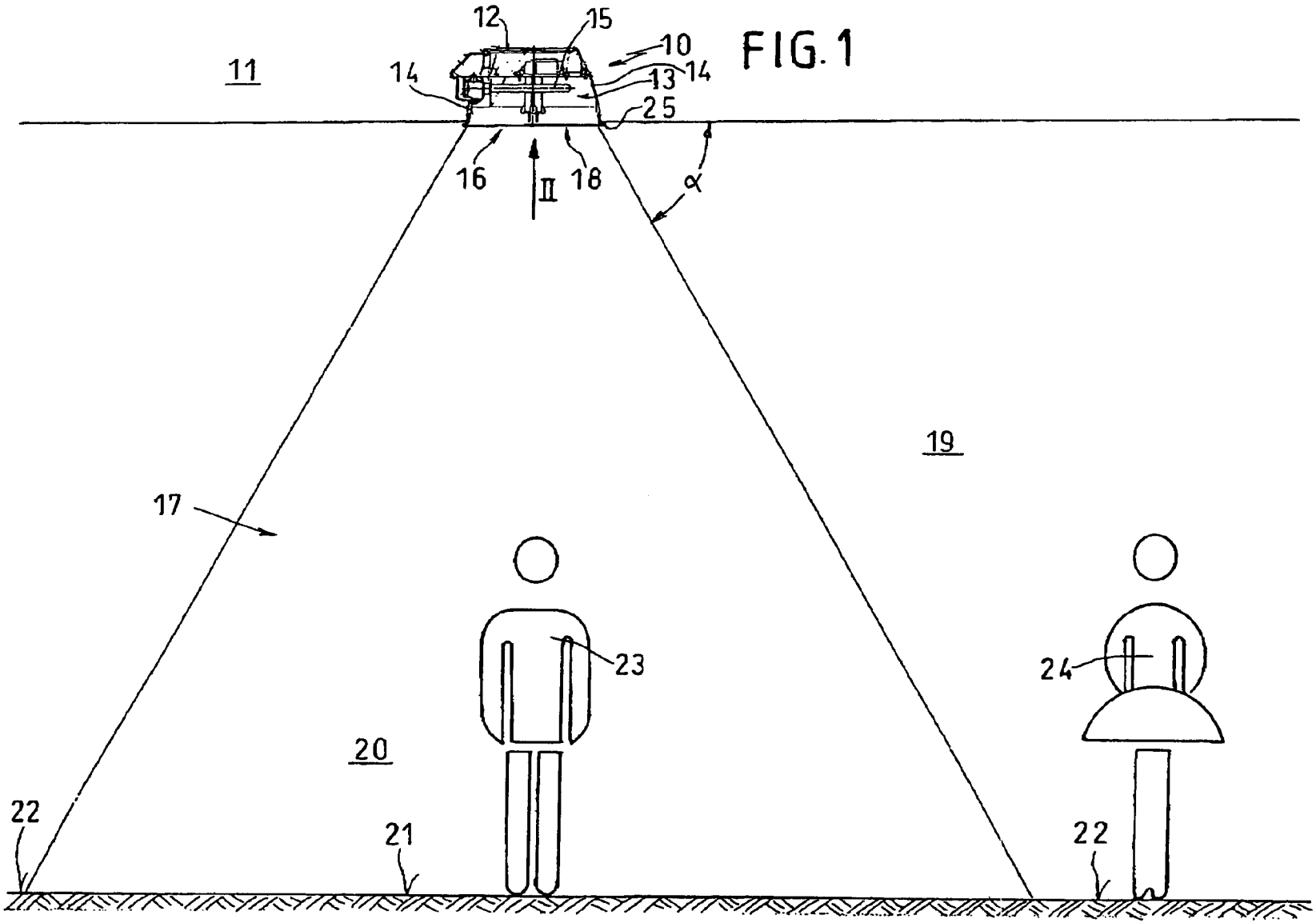
FIG. 1 is a schematic illustration in vertical section of a lamp assembly according to the invention showing diagrammatically one observer within the light cone of the lamp and another observer outside the light cone.

FIG. 1 shows diagrammatically a lamp assembly 10 which is here recessed in a ceiling 11 of a building. The lamp assembly 10 comprises a lamp housing 12 which has only been illustrated diagrammatically and which has an interior 13. In the illustrated embodiment, a reflector element 14 forms the housing 12 or is provided in the housing or constitutes another component of the housing 12.

Within the interior 13 of the housing 12, a compact light source 15 or lamp is provided. This lamp can be a halogen lamp or the like. The lamp preferably is elongated and can extend parallel to the ceiling and floor of the structure. It may be a rod-shaped or bar-shaped lamp or an annular (e.g. circular) lamp. Of course, depending on the nature and purpose of the lamp assembly 10 a multiplicity of lamps 15 may be provided in one and the same chamber 13 or in a plurality of such chambers.

The lamp assemblies 10 has an outlet opening 16 through which the light is cast onto a surface to be illuminated, here the floor 21 within a light cone 17. The light outlet opening 16 for the lamp assembly 10 of the invention is substantially completely closed by a lens plate 18.

The light cone 17 has a relatively well defined cone angle $\alpha$ and thus delimits sharply between the illuminated field within the light cone 17 and the shielded region 19, the shadow, surrounding the light cone. The illuminated field has been indicated at 20 in FIG. 1 and the transition, for example, on the floor 22 between the illuminated region 21 and the region outside the illuminated region is sharply defined as well.

Depending upon the shape of the light outlet opening 16, which can be circular, rectangular or can have some other polygonal or curved edge configuration, the illuminated pattern on the floor will be geometrically similar but, of course, proportionally larger.

To a first viewer 23 within the light cone 17, the region within the light cone is fully and uniformly illuminated. A second viewer 24 in the shadow region 19, i.e. outside the light cone, is in darkness. The second viewer 24, sees the lens plate 18 and thus the entire lamp assembly 10 as a substantially homogeneous dark surface. The lens plate thus appears to be substantially free from bright light points. The region of the room outside the light cone and in which the second viewer 24 may be located can be illuminated by other lamps or by a multiplicity of lamps similar to the lamps of the invention so that there is sufficient illumination for the room, independently of the lamp assembly 10 under consideration.

Since the lens plate 18 to the viewer 24 is a substantially dark surface, it should be apparent that the illumination of the region 21 of the floor 22 is substantially loss free.

To the observer 23 within the light cone 17 and in the illuminated region 20, the lens plate 18 appears as a uniform light emitter such that its structure or geometrical shape can normally not be discerned by that viewer. The lens plate 18 thus appears as a homogeneous light emitting element without bright spots or dark spots.

The lamp assembly of the invention can be used for a wide variety of applications and especially wherever certain areas 21 of a floor must receive a maximum of light from a lamp without adjacent regions being illuminated or without distraction of an observer by light spots or the like.

The angle $\alpha$ which defines the shadow region as well as the illuminated region can be selected at will. It is defined on the one hand by the shape of the reflector element 14 of the lamp assembly and on the other hand by the position and orientation of the lens plate and the configurations of the microlenses. The angle $\alpha$ defines the boundary between the illuminated and nonilluminated regions and preferably is say, 10° to 50° and can be 20° but also 30° or 40° or some angle in between. The lens plate 18 is described in greater detail in connection with FIGS. 2 through 5.

Figure 2:
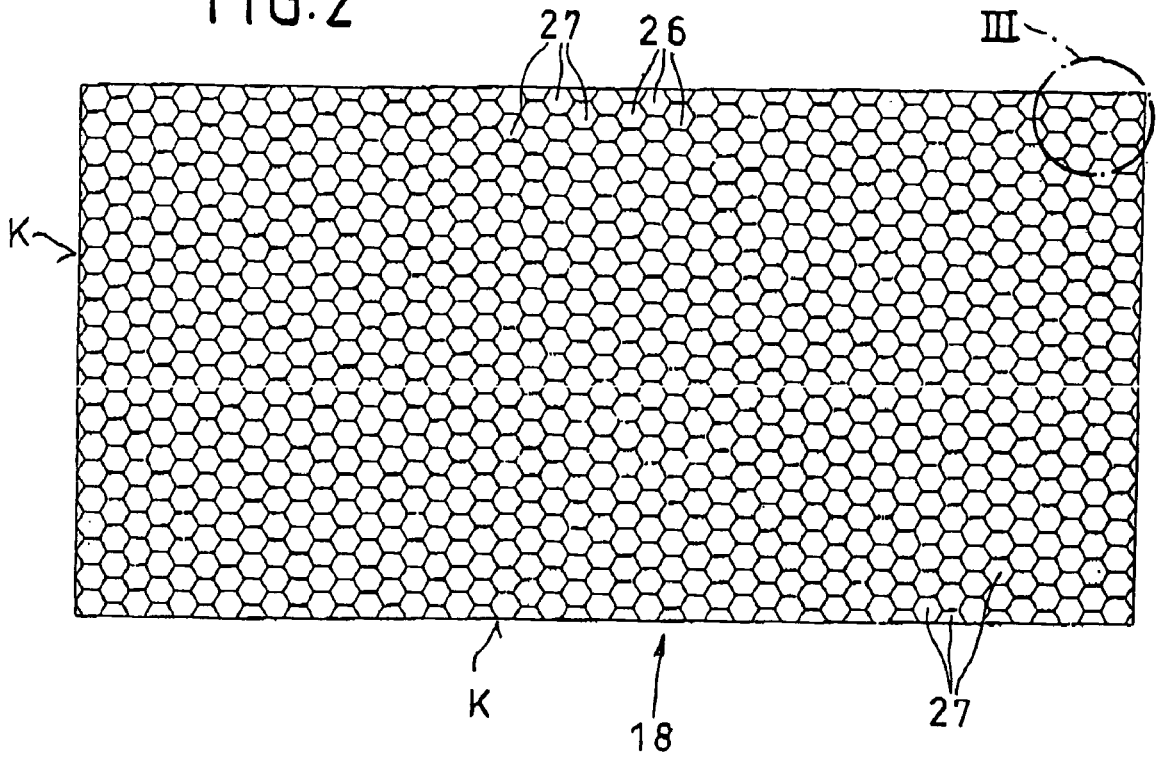
FIG. 2 is a diagrammatic bottom view taken in the direction of the arrow II in FIG. 1 and showing the lens plate of the invention.

FIG. 2 shows, from below in the direction of the arrow II in FIG. 1, a lamp assembly and in which practically only the lens plate 18 is visible. The border 25 is in the form of a frame forming part of the housing of the lamp assembly has been omitted so as to avoid obstructing the edges of the lens plate.

The lens plate 18 has an outer contour K which is matched to the inner contour of the light outlet open 16 (not shown) and closes the latter substantially completely.

The lens plate 18 is seen in FIG. 2 in a diagrammatic form and is shown to have a honeycomb structure. This is, however, only exemplary and is shown in greater detail in FIG. 3.

Figure 3:
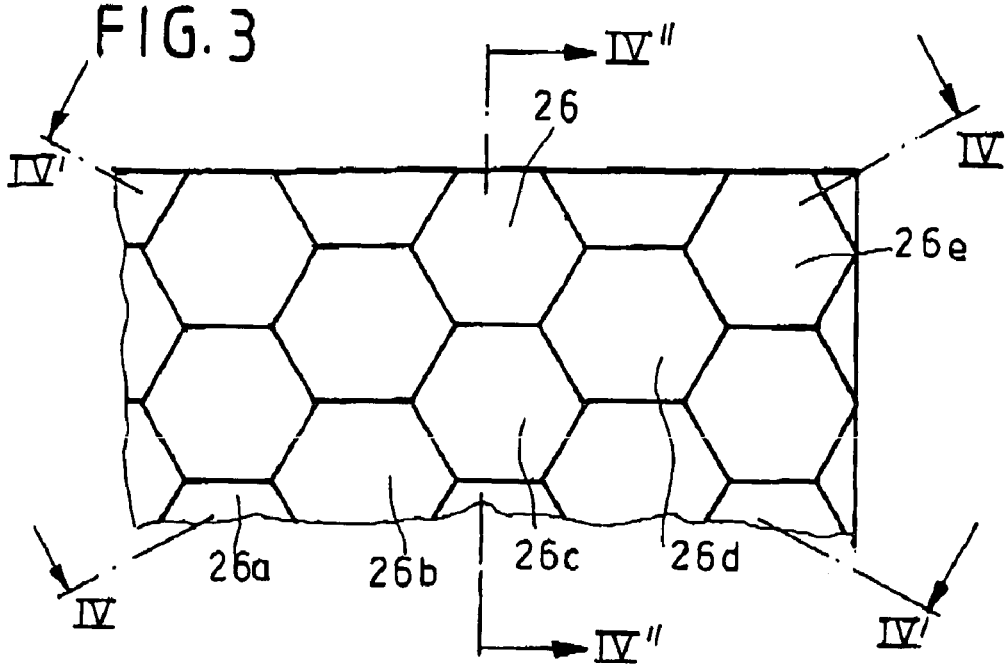
FIG. 3 is a detailed view of a segment of the lens plate in the region defined by the circle III in FIG. 2.

In FIG. 3, it can be seen that the lens plate has a multiplicity of lenses in the shape of honeycomb cells 26 which directly adjoin one another so that these cells bound one another on all sides. Along the cross section line IV—IV, for example, there are formed lenses 26*a*, 26*b*, 26*c*, 26*d*, 26*e* which form a linear row of such cells. Each of these cells 26, 26*a*, 26*b*, 26*c*, 26*d*, 26*e* can have the same lens configuration and the lens configuration or microlens have been indicated generically at 27 and is shown to adjoin microlenses 27 on all sides. In other words, each microlens within the body of the lens plate is surrounded by microlenses on all sides.

Figure 4:
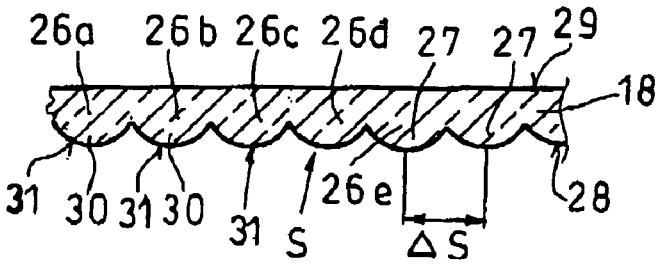
FIG. 4 is a cross sectional view taken along the line IV—IV of FIG. 3 illustrating a first embodiment of the lens plate.

The microlens configuration has been shown in one embodiment in FIG. 4 to be formed by a corresponding structuring of the lower surface 28 of the lens plate 18, i.e. the surface turned toward the floor portion 21 to be illuminated.

In the embodiment of FIG. 4, only the side 28 of the lens plate, namely, its outer side, is structured. The inner side 29, turned toward the lamp 15 is substantially planar.

In the embodiment of FIG. 4, the microlenses 27 are formed by spherical convexities 30. The underside 28 according to FIG. 4 thus is constituted as linear successions of circular arc segments 31 defining the respective convexities and having apexes S with respect to which the arcs are symmetrical in all directions. The cross sections of the microlenses in, for example, the cross sectional plane IV' and IV' and in the cross sectional plane IV"—IV" are the same as in the cross sectional plane IV—IV illustrated in FIG. 4.

Each convexity can be a hemisphere although other spherical segmental configurations can be used as well. The configuration shown in FIG. 4 may be referred to as a spherical cap with the understanding that a spherical cap is a spherical segment which may be greater or similar than a hemisphere. Each arc segment 31 has a curvature with constant radius so that each concavity can form the respective microlens 27. Such microlens are collecting lenses.

Figure 5:
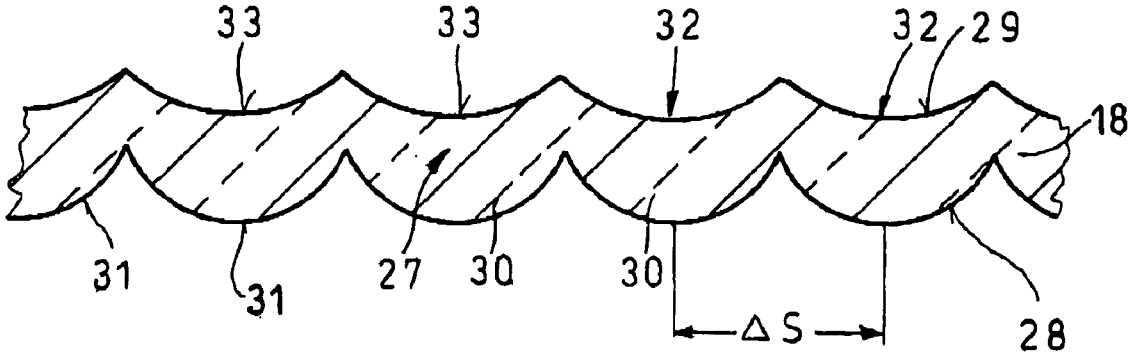
FIG. 5 is an enlarged section similar to that of FIG. 4 but showing a second embodiment of a lens plate according to the invention.

In the alternative embodiment of FIG. 5, the inner side 29 of the lens plate is also structured and formed with spherical concavities or recesses 32 which face the lamp 15. Each of the recesses 32 and the respective convexity 30 are flush with one another to define a microlens 27 which is also a collecting lens.

The recesses 32 also have the geometrical shape of a spherical segment and it is also important that the arc segments 33 defining the recesses have constant radii. Preferably, the radius of curvature of the arc segments 33 are greater than the radius of curvature segments 31.

Because the recesses 32 each register with a convexity, each of the microlenses 27 is of the convex-concave type.

From FIGS. 4 and 5, it will also be apparent that the apexes of the microlenses are spaced apart by a distance $\Delta S$. That distance should be at least 1 mm and preferably is less than 5 mm, more preferably less than 3 mm and most preferably less than 2 mm. The lens plate can be composed of a plastic, especially polymethylmethylacrylate (PMMA) or polycarbonate (PC) and of a clear or matte translucent synthetic resin which only limitedly effects the light output.

The structures surfaces are produced preferably by injection molding of the lens plate in a die in which the surfaces have concavities and convexities complimentary to the convexities 31 and the concavities 32 of the lens plate. The surfaces can also be machined if desired by, for example, the rolling or embossing of a planar workpiece or machined by an abrasive or formed by another material removal process.

Figure 6:
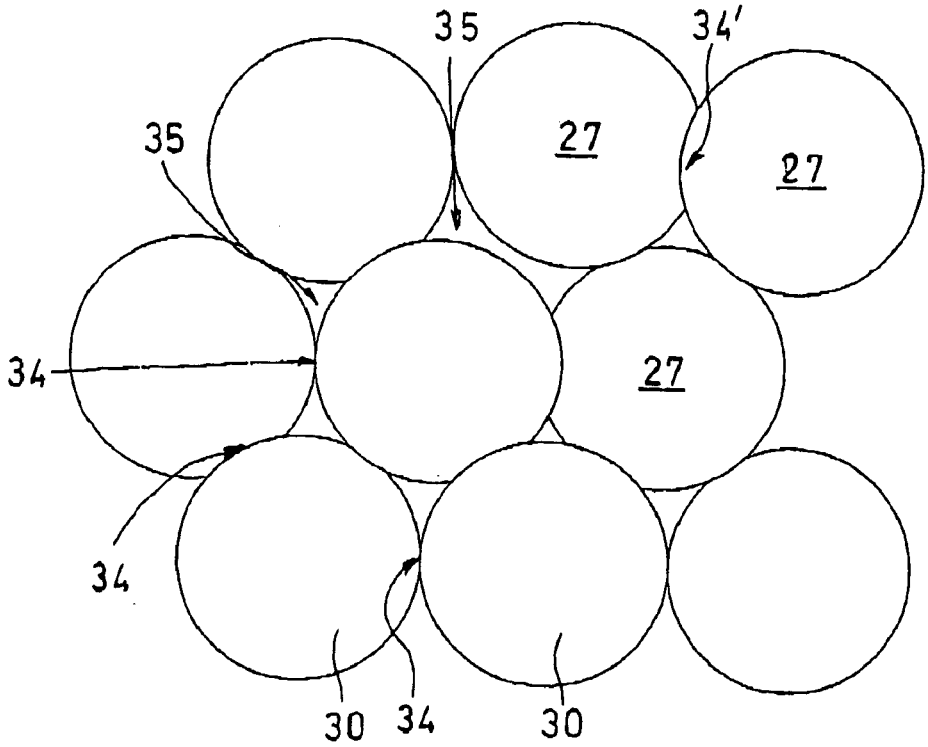
FIG. 6 is a diagram of a third embodiment of a lens plate and illustrating an alternative disposition of microlenses.

While the honeycomb configuration shown in FIG. 2 is preferred, other patterns may be provided as well. FIG. 6 shows another alternative configuration of the underside of a lens plate in which the convexities are also directly adjacent one another and can overlap in regions 34' or simply adjoin one another as in the regions 34.

It is possible that slight spaces 35 may be provided which need not be part of a microlens but are sufficiently small as to be negligible with respect to their efforts on the light distributions.

The radii of the arc segments 31 and 33 depends upon the focal lengths of the microlenses 27 and are selected to match the geometry of the lamp and the spacing of the lens plate 18 from the light source 15 and the desired angle $\alpha$.

I claim:

1. A lamp assembly comprising:

a lamp housing having a light-emitting opening turned in a direction toward a surface to be illuminated;

at least one lamp in said housing for producing light emitted in a light cone toward said surface; and a lens plate disposed across said opening between the lamp and the surface and comprised of a multiplicity of microlenses directly adjacent one another for rendering the light cone as it passes through said lens plate substantially homogeneous and sharp-edged where said light cone meets said surface, said microlenses being formed as structuring of at least one surface of said lens plate, said lens plate having an inner surface turned toward said lamp and an outer surface turned away from said lamp and outwardly away from the housing, said inner surface turned toward said lamp being formed with contiguous generally spherical recesses, the outer surface turned away from the lamp being formed with contiguous generally spherical convexities, said convexities and said recesses forming said microlenses, a spacing ΔS between midpoints of adjacent recesses or adjacent convexities being less than 5 mm and greater than 1 mm.

2. The lamp assembly defined in claim 1 wherein ΔS is less than 3 mm.

3. The lamp assembly defined in claim 1 wherein ΔS is less than 2 mm.

4. The lamp assembly defined in claim 1 wherein said recesses and said convexities are respectively flush with one another.

5. The lens assembly defined in claim 1 wherein said lens plate is composed of a plastic.

6. The lamp assembly defined in claim 1 wherein said lens plate is formed in one piece.

7. The lamp assembly defined in claim 1 wherein said opening is substantially fully closed by said lens plate.

8. The lamp assembly defined in claim 5 wherein said lens plate is composed of polymethylmethacrylate.

9. The lamp assembly defined in claim 5 wherein said lens plate is an injection-molded article.

10. A building-illumination lamp assembly comprising:

a lamp housing adapted to be mounted on a roof or wall of a building and oriented to cast light onto an area to be illuminated, said lamp housing surrounding an interior space and having a light outlet opening directed toward said area;

a lamp in said space for producing light in said housing; and a lens plate in said space spanning said light outlet opening and having a surface turned toward said lamp and another surface turned away from said lamp and toward said area for directing a sharply defined substantially homogeneous light cone onto said area, said surface turned away from said lamp being formed with outwardly directed rounded convexities having apexes defined by arc segments creating microlenses having center-to-center spacings from one another of less than 5 mm and more than 1 mm, said surface turned toward said lamp being smooth or provided with rounded concavities forming the microlenses with said rounded convexities.

* * * * *